US005244154A

United States Patent [19]

Buchholz et al.

[11] Patent Number: 5,244,154

[45] Date of Patent: Sep. 14, 1993

[54] PERFORATED PLATE AND FUEL INJECTION VALVE HAVING A PERFORMATED PLATE

[75] Inventors: Juergen Buchholz, Lauffen; Martin Maier, Moeglingen; Jiri Marek; Hans-Peter Trah, both of Reutlingen, all of Fed. Rep. of Germany

[73] Assignee: Robert Bosch GmbH, Stuttgart, Fed. Rep. of Germany

[21] Appl. No.: 820,827

[22] Filed: Jan. 15, 1992

[30] Foreign Application Priority Data

Feb. 9, 1991 [DE] Fed. Rep. of Germany ..... 4104019

[51] Int. Cl.[5] ..... B05B 1/04; B05B 1/14; F02M 61/16; F02M 69/04

[52] U.S. Cl. ..... 239/590.3; 239/590.5; 239/596; 239/601; 239/585.4; 239/DIG. 19; 239/533.12

[58] Field of Search ..... 239/583-585, 239/590-590.5, 596, 597, 601, DIG. 19, 533.12; 156/644, 647, 657, 662; 346/75, 140 R

[56] References Cited

U.S. PATENT DOCUMENTS 3,921,916 11/1975 Bassous ..... 239/601
4,733,823 3/1988 Waggener et al. ..... 239/601
4,828,184 5/1989 Gardner et al. ..... 239/596
4,907,748 3/1990 Gardner et al. ..... 239/584
5,012,983 5/1991 Buchholz et al. ..... 239/590.5

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

A fuel injection valve including a perforated silicon plate disposed downstream of a valve seat and having an atomization opening that widens in the flow direction. The perforated silicon plate has at least one elongated recess on an upper end face oriented toward the valve seat face; this recess at least partly overlaps a metering opening extending as far as a lower face end of the perforated plate. The perforated plate makes it possible to form flat streams, so that very fine atomization of the injected fuel is attained. Forming the elongated recesses and atomization openings by etching makes high-precision manufacture possible at low production cost. The perforated plate and fuel injection valve are especially suitable for injection systems of mixture-compressing internal combustion engines with externally supplied ignition.

30 Claims, 5 Drawing Sheets

PERFORATED PLATE AND FUEL INJECTION VALVE HAVING A PERFORMATED PLATE

BACKGROUND OF THE INVENTION

The invention is based on a perforated plate and on a fuel injection valve having a perforated plate. European Patent Document 0 354 659 A2 discloses a fuel injection valve having a small silicon nozzle plate disposed downstream of a valve seat; the plate has an atomization opening that widens in the flow direction. This atomization opening produces a cordlike stream, with relatively poor fuel atomization, so that the formation of the most homogeneous possible fuel-air mixture is not assured.

The production of flat streams or fanlike streams, which enable better atomization of the fuel, is known from German Patent Application 39 04 446 A1, U.S. Pat. No. 5,012,983. It provides at least one elongated indentation in the perforated plate, and each indentation discharges into a respective atomization opening. The production cost for the indentations, which have the closest possible dimensional tolerances, is quite high, however, so that the manufacture of this kind of perforated plate entails major expenses. Moreover, adhering to the close manufacturing tolerances for the indentations presents problems in mass production.

OBJECT AND SUMMARY OF THE INVENTION

The perforated plate according to the invention has an advantage over the prior art of enabling the formation of flat streams, because there is at least one elongated recess in the perforated plate, each of which recesses discharges into a respective metering opening, thus providing substantially better atomization of the injected fuel. The formation of the elongated recesses and the atomization openings in the perforated silicon plate by means of etching enables high-precision manufacture. The perforated plate according to the invention can be manufactured in a simple and economical way, because the manufacturing expense is low even with the close manufacturing tolerances necessary. In the production method known as batch processing, which is typical in semiconductor technology, many perforated plates can be manufactured simultaneously.

By varying the geometry of the elongated recesses and atomization openings, for instance by varying the cross sections and/or etching depth of the elongated recesses and atomization openings, the size of the stream and atomization angle can be affected.

The fuel injection valve according to the invention has an advantage of injecting the fuel with particularly fine atomization, and of thus enabling the formation of an especially homogeneous fuel-air mixture. The formation of the at least one elongated recess and the respective atomization opening by etching of the perforate silicon plate enables simple, economical manufacture of the fuel injection valve.

Advantageous further features of and improvements to the perforated plate disclosed are possible with the provisions set forth herein.

One advantageous feature for the sake of especially simple, economical manufacture of the perforated plate and fuel injection valve is for the at least one elongated recess to be formed out beginning at the upper face end and for the at least one atomization opening to be formed out beginning at the lower face end of the perforated plate, by means of two-sided anisotropic etching.

It is especially advantageous if the at least one elongated recess has two long sides extending opposite on another in the direction of the atomization opening, the long edges of which, formed by the upper face end of the perforated plate, extend parallel to one another and to one long axis of the elongated recess; if the at least one atomization opening is embodied quadrilaterally; and if the long axis of the longitudinal recess extends parallel to a diagonal of the quadrilateral atomization opening that joins two opposite corners of the atomization opening to one another. As a result, the fuel is injected from the atomization opening in a flat stream, with particularly fine atomization.

To this end it is advantageous if the two opposed long sides of the elongated recess extend parallel to one another and perpendicular to the upper face end of the perforated plate, and the long edges of the two long sides have the greatest length of all the edges of the elongated recess that are formed by the upper face end of the perforated plate.

It is advantageous if the perforated plate has two elongated recesses disposed side by side, each with one atomization opening. This kind of perforated plate is especially well suited for fuel injection valves for fuel injection systems for internal combustion engines having two inlet valves.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
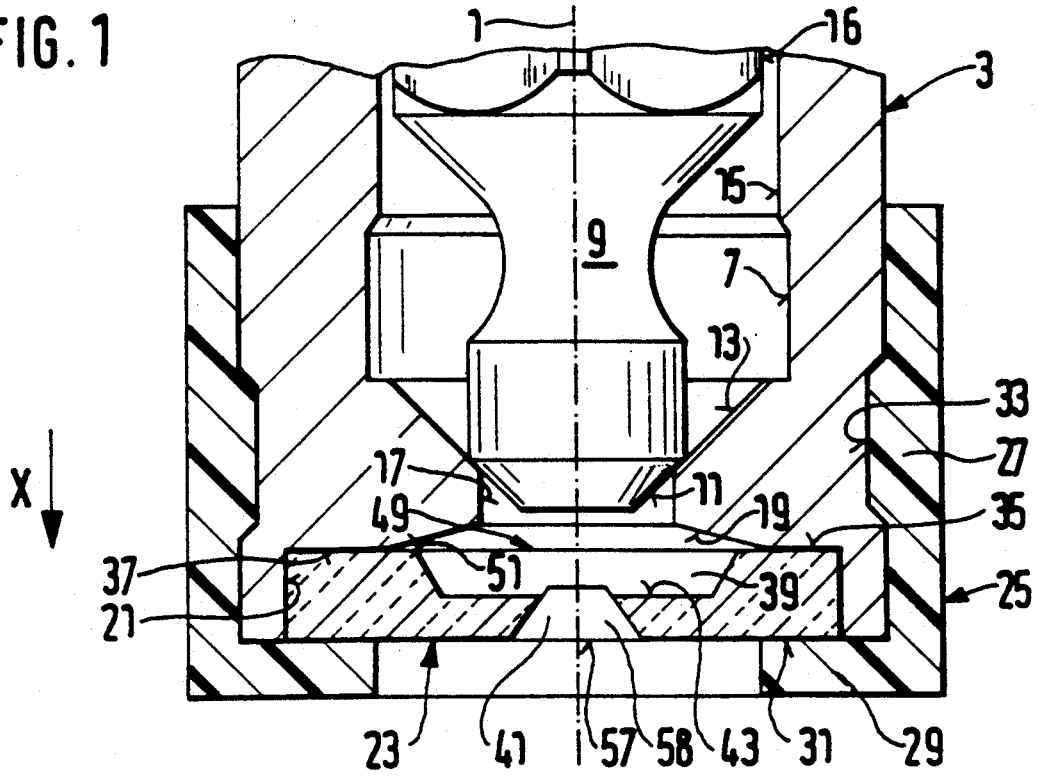
FIG. 1 is a fragmentary view of a fuel injection valve having a perforated plate embodied according to a first exemplary embodiment.

FIG. 1 is a fragmentary view of a fuel injection valve, which for instance can be used for injection systems of mixture-compressing internal combustion engines with externally supplied ignition, having a perforated plate in accordance with a first exemplary embodiment. Concentric with a longitudinal valve axis 1 a nozzle body 3 of the fuel injection valve has a stepped through bore 7. A valve closing body 9 is disposed in the through bore 7. With its downstream end, which is for instance embodied as a sealing region 11 that tapers conically, the valve closing body 9 cooperates with a valve seat face 13, which for instance conically tapers in the flow direction, of the stepped through bore 7 of the nozzle body 3. A guide segment 15 of the through opening 7, embodied upstream of the valve seat face, serves to guide the valve closing body 9 at its at least one guide region 16.

The axial motion of the valve closing body 9 and thus the opening and closing of the valve take place in a known manner, for instance, either mechanically or electromagnetically.

The valve seat face 13 is adjoined downstream, for example, by a flow segment 17 of cylindrical shape, a transition segment 19 that widens radially outward in the flow direction, and a receiving segment 21 of the through bore 7, the wall of which extends parallel to the longitudinal valve axis 1. A perforated plate 23 is disposed in the receiving segment 21 in such a way that the perforated plate 23 is surrounded closely by the wall of the receiving segment 21.

To protect the perforated plate 23 against damage, a protective cap 25 is disposed on the downstream end of the nozzle body 3; with a cylindrical portion 27, it surrounds the circumference of the nozzle body 3 in the region of its downstream end, and with a radial segment 29 pointing radially inward downstream of the perforated plate 23, it rests on a lower face end 31 of the perforated plate 23 remote from the valve seat face 13. The protective cap 25 is retained on the circumference of the nozzle body 3 by a detent connection 33. However, it is also possible for a metal protective cap 25 to be secured to the circumference of the nozzle body 3 by laser welding.

With its upper end face 35 oriented toward the valve seat face 13, the perforated plate 23 rests on a retaining shoulder 37 of the stepped through bore 7 of the nozzle body 3; this retaining shoulder extends inward radially, beginning at the receiving segment 21 and is oriented toward the perforated plate.

Figure 2:
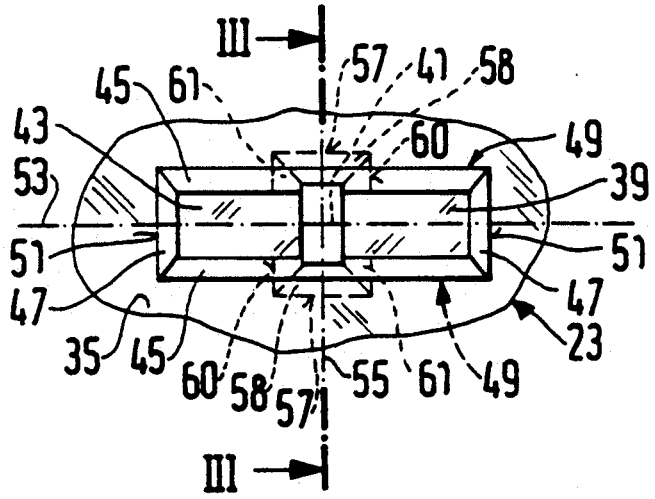
FIG. 2 is a plan view of the perforated plate of the first exemplary embodiment, seen in the direction of the arrow X of FIG. 1.
Figure 3:
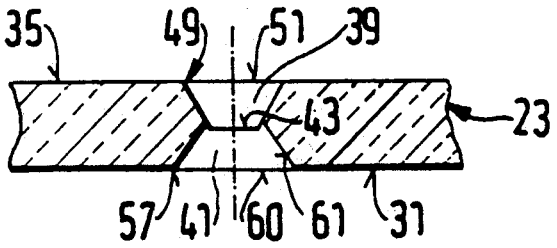
FIG. 3 is a section taken along the line III—III of FIG. 2.

The perforated plate 23 is formed of monocrystalline silicon. FIG. 2 shows a plan view of the perforated plate 23 in the direction of the arrow X in FIG. 1, and FIG. 3 shows a section taken along the line III—III of FIG. 2. Beginning at the upper face end 35, at least one elongated recess 39 is formed in the perforated plate 23, for instance by anisotropic etching; it extends in the direction of the lower face end 31 into the perforated plate 23 as far as a flat bottom 43. The elongated recess 39, of which there is for instance one, partly overlaps with an atomization opening 41, which extends as far as the lower face end 31 of the perforated plate 23, so that the recess 39 and the atomization opening 41 together form a flow conduit that penetrates the perforated plate 23. The atomization opening 41 is formed for instance by anisotropic etching, beginning at the lower face end 31 of the perforated plate 23. To reduce the production cost of such a perforated plate 23, it is possible to form the elongated recess 39 and the atomization opening 41 in the same operation, by two-sided anisotropic etching. The result is identical etching depths and thus identical length in the direction of the longitudinal valve axis 1 for both the elongated recess 39 and the atomization opening 41.

On the upper face end 35, the elongated recess 39 has a rectangular opening cross section, which tapers, oriented toward the lower face end 31 of the perforated plate 23, as far as the bottom 43 of the elongated recess 39. The wall of the elongated recess 39 is formed by two long sides 45 and two transverse sides 47, each extending at an inclination to the longitudinal valve axis 1. The long sides 45, with the upper face end 35 of the perforated plate 23, each form one long edge 49, and each of the transverse sides 47 form a transverse edge 51; the two long edges 49 extend parallel to one another, and the two transverse edges 51 extend parallel to one another. In the first exemplary embodiment, shown in FIGS. 1–3, the long edges 49 have a greater edge length than the transverse edges 51 of the elongated recess 39. Parallel to the long edges 49, the elongated recess 39 has a longitudinal axis 53, and perpendicular to the longitudinal axis, the recess 39 has a transverse axis 55, extending parallel to the transverse edges 51; both the long axis 53 and the transverse axis 55 extend like axes of symmetry of the elongated recess, and the long axis 53 and the transverse axis 55 for instance intersect at one point of the longitudinal valve axis 1. Beginning at the bottom 43 of the elongated recess 39, the atomization opening 41, which for instance is rectangular, extends concentrically to the elongated recess 39, for example, in the direction of the lower end face 31 of the perforated plate 23. The cross section of the atomization opening 41 widens in the flow direction.

The atomization opening 41 has two opposed long sides 58, which with the lower face end 31 of the perforated plate 23 each form one long edge 57. The long edges 57 of the atomization opening 41 extend parallel to the longitudinal axis 53 of the elongated recess 49 and have a substantially shorter edge length than the long edges 49 of the elongated recess 39; the ratio of edge length of the long edges 49 of the elongated recess 39 to the long edges 57 of the atomization opening 41 is approximately 1.5:1 to 10:1. One transverse edge 60, each formed by the lower end face 31, of a transverse side 61 of the atomization opening 41 extends perpendicular to the long edges 57. For production reasons, the transverse edges 60 also have a somewhat greater edge length, for instance by approximately 5 to 30 $\mu$m, than the transverse edges 51 of the elongated recess 39. The transverse edges 60 of the atomization opening 41 may have an edge length up to two times greater than the transverse edges 51. As a result, the length of the long sides 45 of the elongated recess 39 in the direction of the longitudinal valve axis 1 is reduced, with partial overlapping of the elongated recess 39 and the atomization opening 41 in the region of the long sides 58 of the atomization opening 41; this lessens the deflection of the fuel stream as it emerges from the atomization opening 41 in the direction of the transverse axis 55.

Figure 4:
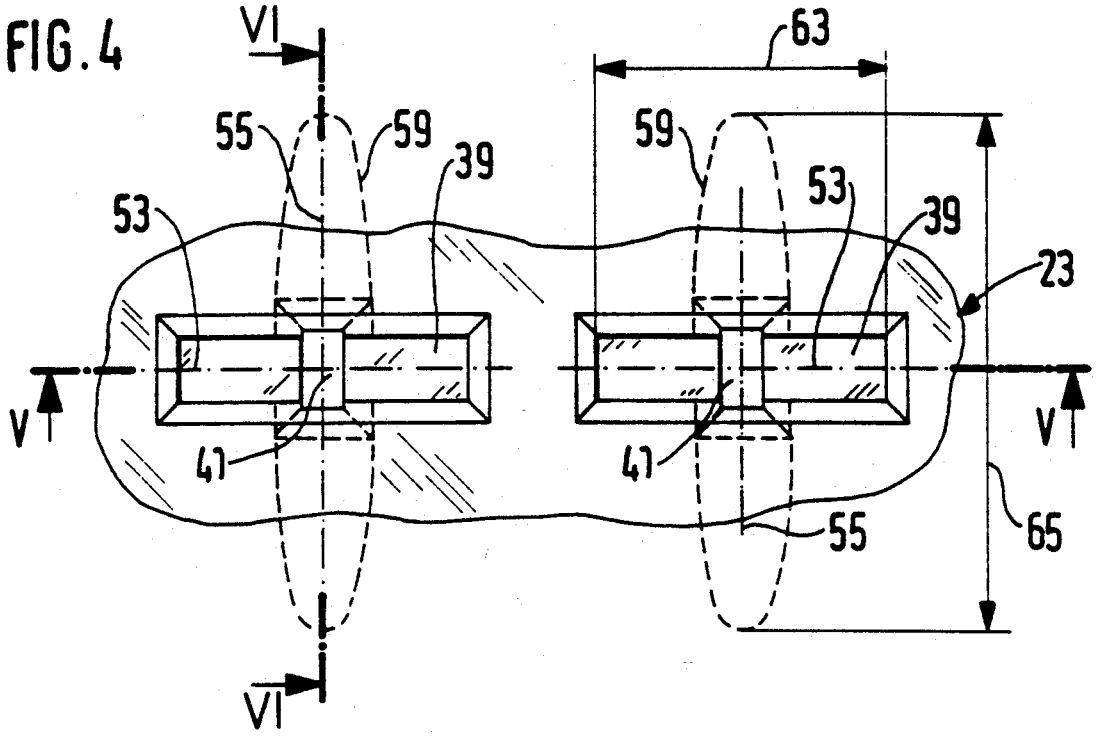
FIG. 4 is a plan view of a perforated plate in accordance with a second exemplary embodiment.
Figure 5:
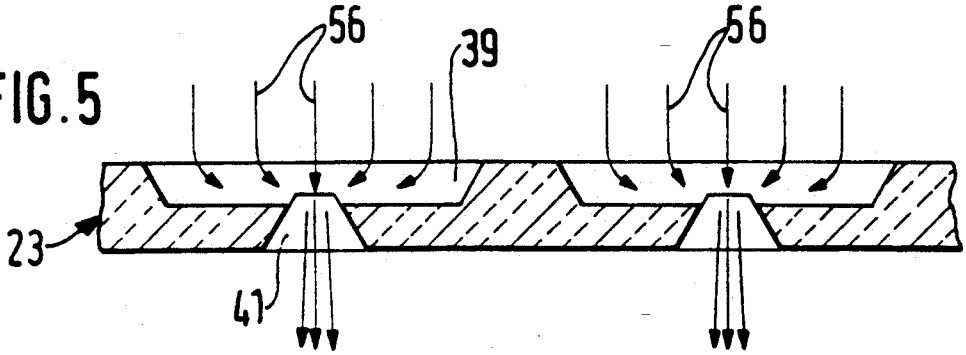
FIG. 5 is a section taken along the line V—V.
Figure 6:
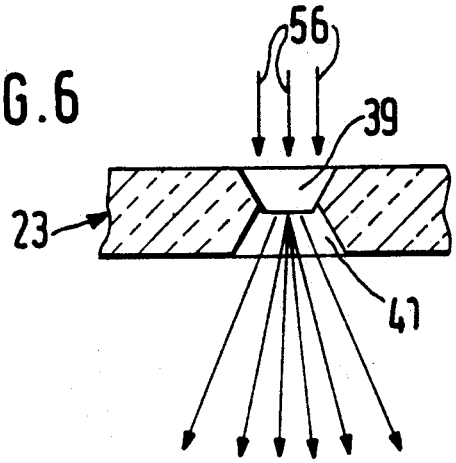
FIG. 6 is a section along the line VI—VI of FIG. 4, with the flow course of the fuel and the stream formation suggested in FIGS. 4–6.

FIGS. 4–6 show a second exemplary embodiment of the invention, in which elements that are the same and function the same have the same reference numerals as in FIGS. 1–3. The perforated plate has two spaced elongated recesses 39, disposed spaced apart side by side, each partly overlapping with an atomization opening 41. The two elongated recesses 39 are disposed such that their two longitudinal axes 53 extend parallel to one another on a common line. The elongated recesses 39 and the atomization opening 41 are embodied exactly as in the first exemplary embodiment of FIGS. 1–3. In FIGS. 4–6, the flow course of the fuel is suggested by arrows 56, to make the mode of operation of the perforated plate of the invention clear. The geometry of the elongated recess 39 and atomization opening 41 has the effect, as shown in FIGS. 4–6, of diverting the flow 56 of fuel. In the region of elongated recess 39, the flow 56 is diverted in the direction of the bottom 43, so that two halves of the flow of fuel, which flow toward one another in the direction of the longitudinal axis 53, strike one another above the atomization opening 41. Because of the transition of the elongated recess 39 to the atomization opening 41, which has a narrow cross section, and because of the impact of the halves of the flow on one another, the fuel flow 56 upon emerging from the atomization opening 41 is spread out in the form of a flat stream in the direction of the transverse axis 55 and atomized, as suggested by the dashed line 59. This fuel flow injected in the form of a flat stream, as suggested by the dashed line 59, has the advantage of especially fine atomization.

By varying the geometry of the recesses 39 and atomization openings 41, for instance by varying the etching depths and cross-sectional size of the elongated recesses 39 and atomization openings 41, the shape of the flat stream defined by the dashed line 59 and the size of the atomization angle can be varied.

For instance, if the length 63 of the bottom 43 of the elongated recess 39 is varied in the direction of the longitudinal axis 53 of the perforated plate 23, then the width 65 of the flat stream defined by the dashed line 59 varies as well in the direction of the transverse axis 55 of the perforated plate 23, and thus the size of the atomization angle also changes.

The perforated plate of the second exemplary embodiment, shown in FIGS. 4–6, is especially well-suited to use in fuel injection valves for internal combustion engines that have two inlet valves per cylinder; each flat stream defined by the dashed line 59 is assigned to one inlet valve.

However, it is also possible to provide three or more elongated recesses 39 and atomization openings 41 in the perforated plate 23.

Figure 7:
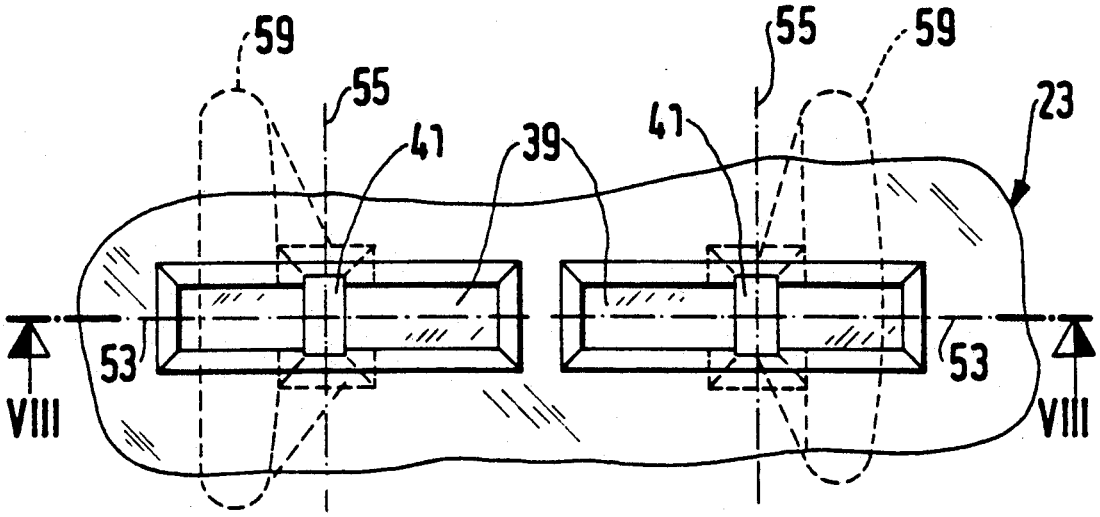
FIG. 7 is a plan view of a perforated plate in accordance with a third exemplary embodiment, in which the flow course and stream formation of the fuel are suggested.
Figure 8:
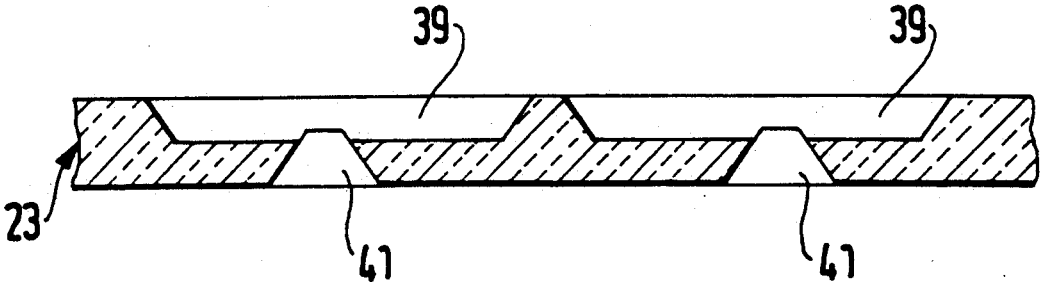
FIG. 8 is a section taken along the line VIII—VIII of FIG. 7.

The perforated plate 23 of the third exemplary embodiment, shown in FIGS. 7 and 8, FIG. 8 showing a section along the line VIII—VIII of FIG. 7, like the perforated plate of the second exemplary embodiment, has two rectangular elongated recesses 39 disposed side by side; each partly overlaps a rectangular atomization opening 41. Elements that are the same and function the same are identified by the same reference numerals as in FIGS. 1–6. In contrast to the first and second exemplary embodiments, in the third exemplary embodiment the elongated recess 39 and the atomization opening 41 are not formed out concentrically with one another. The atomization opening 41 of the left elongated recess 39 is shifted to the left, and the atomization opening 41 of the right elongated recess 39 is shifted to the right. As a result, it is attained that the two flat streams injected from the two atomization openings 41 located asymmetrically with respect to the elongated recesses 39, again defined as in FIG. 7 by the dashed lines 59, are likewise offset asymmetrically in directions remote from one another with respect to the respective transverse axis 55. As the dashed line 59 suggests, the deflection of the flat stream is away from the transverse axis 55 toward the side of the elongated recess 39 toward which the atomization opening 4 is shifted along the longitudinal axis 53. This form of embodiment with the two divergent flat streams has proved advantageous, because it effectively avoids mixing of the two flat fuel streams and thus their influence on one another.

Figure 9:
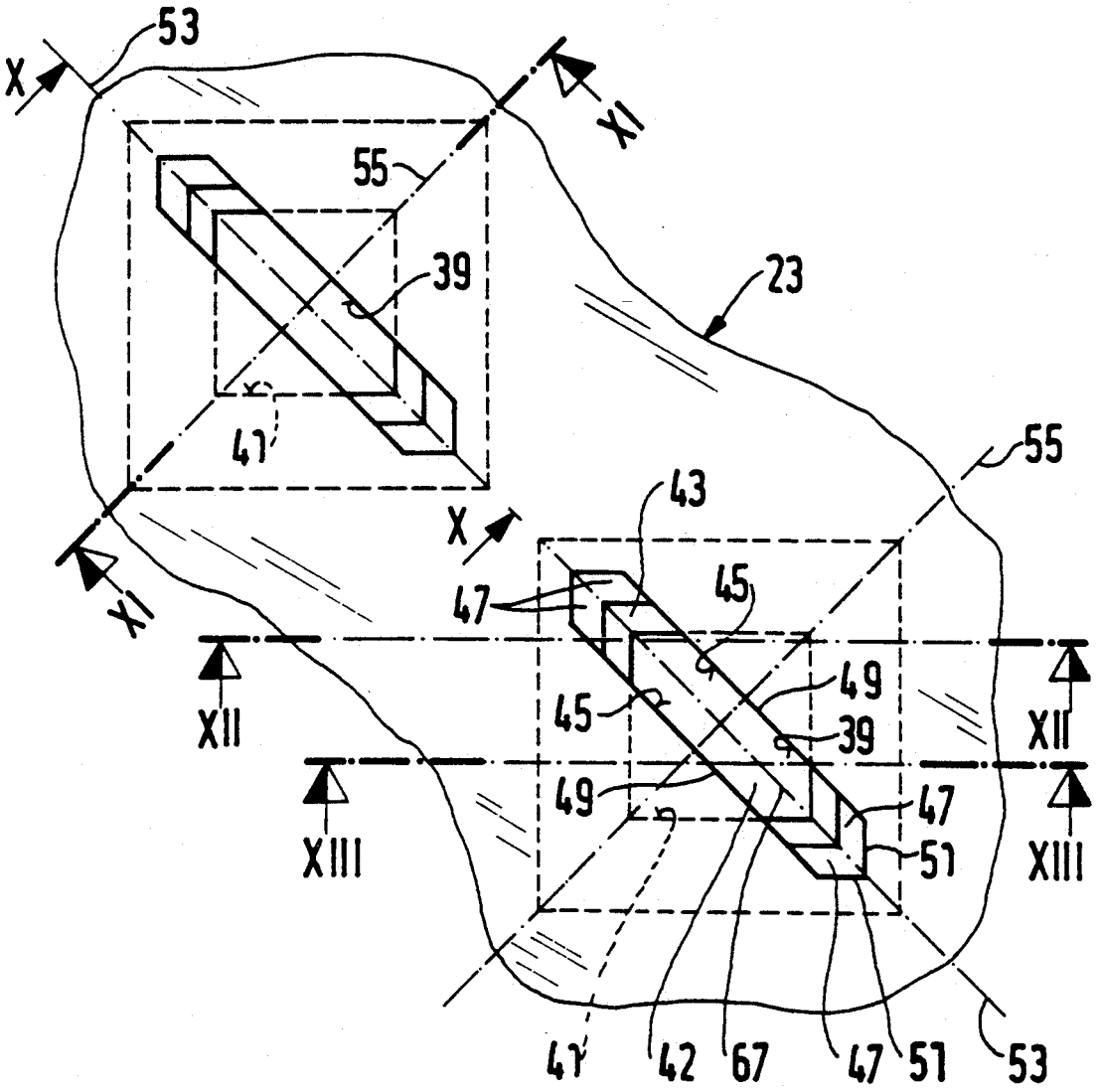
FIG. 9 is a plan view of a perforated plate in accordance with a fourth exemplary embodiment.
Figure 10:
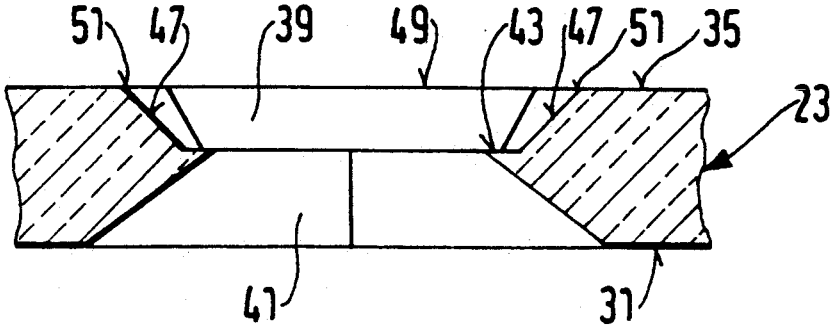
FIG. 10 is a section taken along the line X—X of FIG. 9.
Figure 11:
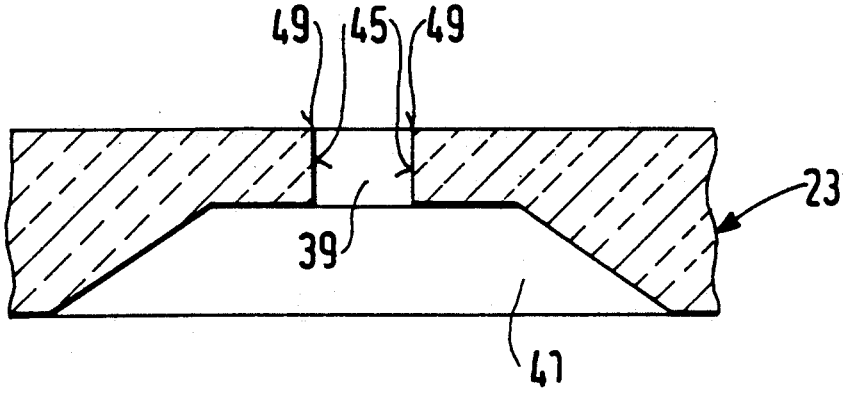
FIG. 11 is a section taken along the line XI—XI of FIG. 9.
Figure 12:
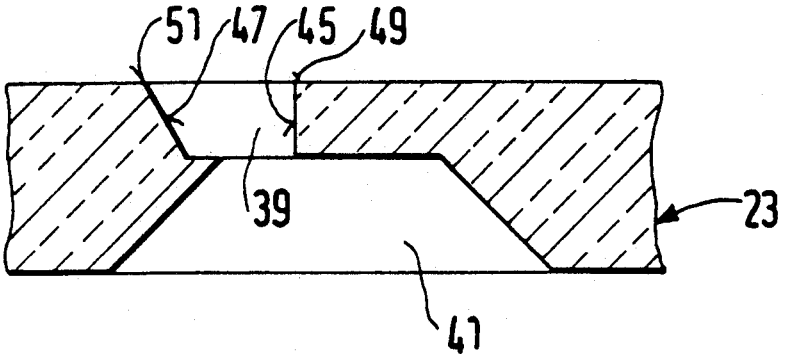
FIG. 12 is a section taken along the line XII—XII of FIG. 9.
Figure 13:
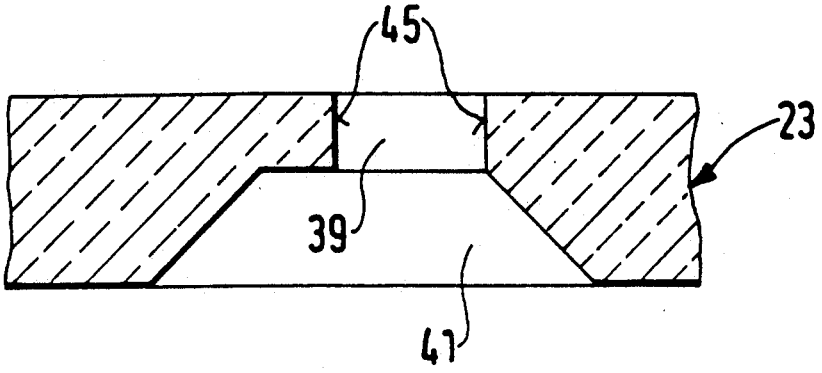
FIG. 13 is a section taken along the line XIII—XIII of FIG. 9.

A fourth exemplary embodiment of a perforated plate according to the invention is shown in FIGS. 9–13. Identical elements and those that function the same are identified by the same reference numerals as in FIGS. 1–8. In FIG. 9, a perforated plate 23 is shown, made of monocrystalline silicon and having geometrically identical elongated recessed 39, the recesses for instance being two in number; the recesses are spaced apart from one another, and toward the lower end face 31 of the perforated plate 23 they each partly overlap a rectangular atomization opening 41; the two atomization openings 41 likewise have identical geometrical dimensions. FIG. 10 shows a section taken along the line X—X of FIG. 9, FIG. 11 shows a section taken along the line XI—XI of FIG. 9, FIG. 12 shows a section taken along the line XII—XII of FIG. 9, and FIG. 13 shows a section taken along the line XIII—XIII of FIG. 9. The two elongated recesses 39, as the plan view of the perforated plate 23 of FIG. 9 shows have a hexagonal opening cross section on the upper end face 35; this tapers in the direction of the bottom 43 of the elongated recess 39 toward the lower end face 31 of the perforated plate 23.

The wall of the elongated recess 39 is embodied by two long sides 45, extending perpendicular of the upper end face 35 of the perforated plate 23, and four transverse sides 47, extending at an incline to the longitudinal valve axis 1; two transverse sides 47 each border one another. The long sides 45 and the upper face end 35 of the perforated plate 23 each form one long edge 49, and each of the transverse sides 47 forms one transverse edge 51. The two long edges 49 and two opposed transverse edges 51 all extend parallel to one another, respectively. In the fourth exemplary embodiment shown, the long edges 49 have a substantially greater edge length than the transverse edges 51. The two transverse edges 51 of the transverse sides 47 bordering one another form a right angle with one another and have the same length. By their other ends, these transverse edges 51 border the long edges 49 of the elongated recess 39 at an obtuse angle. Parallel to the long edges 49, the elongated recesses 39 have a longitudinal axis 53, and perpendicular to it they have a transverse axis 55, these axes extending like axes of symmetry of the elongated recess 39. The longitudinal axis 53 and the transverse axis 55 intersect in the center of the elongated recess 39.

From the bottom 43 of the elongated recess 39, the quadrilateral, for instance rectangular or square, atomization opening 41 extends concentrically with the elongated recess 39 in the direction of the lower end face 31 of the perforated plate 23. The cross section of the atomization opening 41 widens in the flow direction. The elongated recess 39 and the atomization opening 41 are disposed with respect to one another such that the longitudinal axis 53 of the elongated recess 39 extends parallel and for instance congruently with a diagonal 67 of the square atomization opening 41 that joins two opposed corners of the atomization 41 to one another.

The cooperation of the elongated recess 39 and the square atomization opening 41, which is only partly open toward the bottom 43, produces a hexagonal opening cross section of the perforated plate 23.

The shaping of the elongated recess 39 and atomization opening 41 results in a deflection of the fuel flow at the oblique transverse sides 47 and at the bottom 43. In the region of the elongated recess 39, because of the deflection at the bottom 43, two halves of the flow of fuel that flow toward one another in the direction of the longitudinal axis 53 meet. Because of the transition of the elongated recess 39 into the atomization opening 43 in the region of its bottom 41 and the impact of the two flow halves on one another, the fuel flow is spread out in the form of a flat stream, so that particularly fine fuel atomization is attained.

As in the first three exemplary embodiments, the shape and orientation of the flat stream and the size of the atomization angle of the fuel can be varied by varying the geometry of the elongated recesses 39 and atomization openings 41 and by varying their relative positions.

The perforated plate 23 according to the invention and the fuel injection valve having a perforated plate 23 according to the invention enable very fine atomization of the injected fuel. High-precision manufacture at nevertheless low production cost is attained by the embodiment of the elongated recess 39 and atomization opening 41 in the perforated silicon plate by means of etching.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A perforated plate of monocrystalline silicon including an upper face surface (35) and a lower face surface (31) with at least one elongated atomization opening, the perforated plate (23) has at least one elongated recess (39) formed in said upper face surface by etching, said at least one elongated recess forms an elongated cross section in a plane parallel with said upper surface of said perforated plate, said at least one elongated atomization opening (41) is formed in said lower face surface concentrically with said elongated recess (39) by etching with said at least one elongated recess overlapping said at least one elongated atomization opening (41), said at least one atomization opening extending from said lower face surface (31) of the perforated plate (23) toward said at least one elongated recess with the at least one elongated atomization opening perpendicular with said at least one elongated recess.

2. A perforated plate as defined by claim 1, in which the at least one elongated recess (39), beginning at the upper face surface (35), and the at least one atomization opening (41), beginning at the lower face surface (31) of the perforated plate (23), are formed out by two-sided anisotropic etching.

3. A perforated plate as defined by claim 2, in which the at least one elongated recess (39) tapers in a direction toward the atomization opening (41).

4. A perforated plate as defined by claim 1, in which the at least one elongated recess (39) tapers in a direction toward the atomization opening (41).

5. A perforated plate as defined by claim 1, in which the at least one atomization opening (41) widens toward the lower face surface (31) of the perforated plate (23).

6. A perforated plate as defined by claim 1, in which the perforated plate (23) has two elongated recesses (39), disposed side by side, with one atomization opening (41) for each recess.

7. A perforated plate as defined by claim 1, in which the elongated recess (39) and the atomization opening (41) are embodied as concentric with one another.

8. A perforated plate as defined by claim 1, in which the elongated recess (39) and the atomization opening (41) are embodied asymmetrically to one another.

9. A perforated plate of monocrystalline silicon having at least one atomization opening, the perforated plate (23) from an upper face surface (35) of said perforated plate has at least one elongated recess (39) formed by etching, said at least one elongated recess partly overlaps a respective at least one atomization opening (41) formed out by etching and extending as far as a lower face surface (31) of the perforated plate (23), said at least one elongated recess (39) has two opposed long sides (45) extending in a direction of the atomization opening (41), said long sides include long edges (49) formed along the upper face surface (35) of the perforated plate (23), said long edges extend parallel to one another and parallel to a longitudinal axis (53) of the recess (39); said at least one atomization opening (41) is embodied as quadrilateral; and that the longitudinal axis (53) of the elongated recess (39) extends parallel to a diagonal line (67) of the quadrilateral atomization opening (41) that joins two opposed corners of the atomization opening (41) to one another.

10. A perforated plate as defined by claim 9, in which the two opposed long sides (45) of the elongated recess (39) extend parallel to one another and perpendicular to the upper face surface (35) of the perforated plate (23).

11. A perforated plate as defined by claim 10, in which the long edges (49) of the long sides (45) have the greatest length of all the edges of the elongated recess (39) that are formed with the upper face surface (35) of the perforated plate (23).

12. A perforated plate as defined by claim 10, in which the at least one elongated recess (39) tapers in a direction toward the atomization opening (41).

13. A perforated plate as defined by claim 9, in which the long edges (49) of the long sides (45) have the greatest length of all the edges of the elongated recess (39) that are formed with the upper face (35) of the perforated plate (23).

14. A perforated plate as defined by claim 13, in which the at least one elongated recess (39) tapers in a direction toward the atomization opening (41).

15. A perforated plate as defined by claim 9, in which the at least one elongated recess (39) tapers in a direction toward the atomization opening (41).

16. A fuel injection valve for fuel injection systems of internal combustion engines, having a perforated plate that is disposed downstream of a valve seat face of a nozzle body of the fuel injection valve, said perforated plate has at least one quadrilateral atomization opening and is embodied of monocrystalline silicon, said perforated plate (23) has at least one elongated recess (39) formed by etching from an upper face surface (35) oriented toward the valve seat face (13), said at least one elongated recess partly overlaps a respective at least one quadrilateral atomization opening (41) formed out by etching and extending as far as a lower face surface (31) of the perforated plate (23), and said at least one recess forms an elongated cross section in a plane parallel to the upper face surface.

17. A valve as defined by claim 16, in which the perforated plate (23) has two elongated recesses (39), disposed side by side, with one atomization opening (41) for each recess.

18. A valve as defined by claim 17, in which the elongated recess (39) and the atomization opening (41) are embodied as concentric with one another.

19. A valve as defined by claim 16, in which the elongated recess (39) and the atomization opening (41) are embodied as concentric with one another.

20. A perforated plate as defined by claim 16, in which the elongated recess (39) and the atomization opening (41) are embodied asymmetrically to one another.

21. A fuel injection valve for fuel injection systems of internal combustion engines, having a perforated plate that is disposed downstream of a valve seat face of a nozzle body of the fuel injection valve, said perforated plate has at least one atomization opening and is embodied of monocrystalline silicon, said perforated plate (23) has at least one elongated recess (39) formed by etching on one upper face surface (35) oriented toward the valve seat face (13), said at least one elongated recess partly overlaps at least one respective atomization opening (41) formed by etching and extending as far as a lower face surface (31) of the perforated plate (23), said at least one elongated recess (39) has two opposed long sides (45) extending in a direction of the at least one atomization opening (41), said long sides include long edges (49) formed along the upper face surface (35) of the perforated plate (23), the long edges extend parallel to one another and parallel to a longitudinal axis (53) of the recess (39); said at least one atomization opening (41) is embodied as quadrilateral; and that the longitudinal axis (53) of the elongated recess (39) extends parallel to a diagonal line (67) of the quadrilateral atomization opening (41) that joins two opposed corners of the atomization opening (41) to one another.

22. A valve as defined by claim 21, in which the two opposed long sides (45) of the elongated recess (39) extend parallel to one another and perpendicular to the upper face surface (35) of the perforated plate (23).

23. A valve as defined by claim 22, in which the long edges (49) of the long sides (45) have the greatest length of all the edges of the elongated recess (39) that are formed with the upper face surface (35) of the perforated plate (23).

24. A valve as defined by claim 22, in which the perforated plate (23) has two elongated recesses (39), disposed side by side, with one atomization opening (41) for each recess.

25. A valve as defined by claim 22, in which the elongated recess (39) and the atomization opening (41) are embodied as concentric with one another.

26. A perforated plate as defined by claim 22, in Which the elongated recess (39) and the atomization opening (41) are embodied asymmetrically to one another.

27. A valve as defined by claim 21, in which the long edges (49) of the long sides (45) have the greatest length of all the edges of the elongated recess (39) that are formed with the upper face surface (35) of the perforated plate (23).

28. A valve as defined by claim 21, in which the perforated plate (23) has two elongated recesses (39), disposed side by side, with one atomization opening (41) for each recess.

29. A valve as defined by claim 21, in which the elongated recess (39) and the atomization opening (41) are embodied as concentric with one another.

30. A perforated plate as defined by claim 21, in which the elongated recess (39) and the atomization opening (41) are embodied asymmetrically to one another.

* * * * *